US005445756A

United States Patent [19]

Didier et al.

[11] Patent Number: 5,445,756

[45] Date of Patent: Aug. 29, 1995

[54] STABLE LIQUID DETERGENT COMPOSITIONS CONTAINING PEROXYGEN BLEACH SUSPENDED BY A HYDROPHOLIC SILICA

[75] Inventors: Gazeau Didier, le Renouveau, France; Christiaan A. Thoen, Hassdonk, Belgium

[73] Assignee: The Procter & Gamble Company, Cincinnati, Ohio

[21] Appl. No.: 39,034

[22] PCT Filed: Oct. 15, 1991

[86] PCT No.: PCT/US91/07607

§ 371 Date: May 20, 1994

§ 102(e) Date: May 20, 1994

[87] PCT Pub. No.: WO92/07057

PCT Pub. Date: Apr. 30, 1992

[30] Foreign Application Priority Data

Oct. 22, 1990 [EP] European Pat. Off. ..... 90870198

[51] Int. Cl.[6] ..... C11D 3/12; C11D 3/395; C11D 3/43; C11D 17/08

[52] U.S. Cl. ..... 252/104; 252/95; 252/99; 252/173; 252/174.15; 252/174.21; 252/174.24; 252/174.25; 252/DIG. 14

[58] Field of Search ..... 252/95, 99, 104, 173, 252/174.15, 174.25, DIG. 14

[56] References Cited

U.S. PATENT DOCUMENTS

| | | | |
|---|---|---|---|
| 3,332,880 | 7/1967 | Kessler et al. | 252/161 |
| 3,925,262 | 12/1975 | Laughlin et al. | 252/526 |
| 3,929,678 | 12/1975 | Laughlin et al. | 252/526 |
| 3,966,432 | 6/1976 | Rayner | 51/308 |
| 3,996,152 | 12/1976 | Edwards et al. | 252/186 |
| 4,170,565 | 10/1979 | Flesher et al. | 252/93 |
| 4,240,920 | 12/1980 | de Luque | 252/99 |
| 4,265,779 | 5/1981 | Gandolfo et al. | 252/135 |
| 4,368,147 | 1/1983 | Inamorato et al. | 252/545 |
| 4,395,352 | 7/1983 | Kulkarni | 252/321 |
| 4,457,856 | 7/1984 | Mitchell | 252/166 |
| 4,515,704 | 5/1985 | Akred et al. | 252/135 |
| 4,689,167 | 8/1987 | Collins et al. | 252/95 |
| 4,749,512 | 6/1988 | Broze et al. | 252/174.18 |
| 4,753,750 | 6/1988 | Ouhadi et al. | 252/139 |
| 4,790,949 | 12/1988 | Dankowski | 252/95 |
| 4,793,943 | 12/1988 | Haslop et al. | 252/135 |
| 4,798,679 | 1/1989 | Castro | 252/174.15 |
| 4,800,035 | 1/1989 | Broze et al. | 252/99 |
| 4,891,147 | 1/1990 | Gray et al. | 252/104 |
| 5,084,198 | 1/1992 | Ahmed et al. | 252/99 |

FOREIGN PATENT DOCUMENTS

| | | | |
|---|---|---|---|
| 773.670 | 10/1971 | Belgium . | |
| 0079646 | 11/1982 | European Pat. Off. . | |
| 081908A | 6/1983 | European Pat. Off. | 252/174.15 |
| 0203660 | 5/1986 | European Pat. Off. . | |
| 0293040 | 5/1988 | European Pat. Off. . | |
| 0294904 | 6/1988 | European Pat. Off. . | |
| 0295021 | 6/1988 | European Pat. Off. . | |
| 0283791 | 9/1988 | European Pat. Off. | C11D 3/395 |
| 0338921 | 4/1989 | European Pat. Off. . | |
| 0353075 | 1/1990 | European Pat. Off. | C11D 3/12 |
| 0430330 | 11/1990 | European Pat. Off. . | |
| 2031455 | 10/1978 | United Kingdom . | |
| 1531751 | 11/1978 | United Kingdom | C11D 10/02 |

*Primary Examiner*—Dennis Albrecht
*Attorney, Agent, or Firm*—Michael D. Jones; Jerry J. Yetter; Jacobus C. Rasser

[57] ABSTRACT

Stable liquid detergent compositions comprising bleach, a solid water-soluble peroxygen compound, such as perborate and percarbonate, surfactant, builder, and hydrophobic silica as a suspending aid are provided. The water-soluble peroxygen compound is suspended in the liquid phase which contains water and water-miscible organic solvent. Less than one tenth of the peroxygen compound is dissolved in the liquid phase.

11 Claims, No Drawings

STABLE LIQUID DETERGENT COMPOSITIONS CONTAINING PEROXYGEN BLEACH SUSPENDED BY A HYDROPHOLIC SILICA

TECHNICAL FIELD

The present invention relates to stable liquid detergent compositions containing bleach, comprising a solid water-soluble peroxygen compound suspended in a liquid phase, surfactant and further comprising hydrophobic silica.

BACKGROUND

There have been several attempts to provide liquid detergent compositions that could have bleach-type components or additives. However, the most stable compositions have often had certain problems including dissolution problems, or uneven distribution or application of the components or additives. There have also been problems in many compositions of the prior art in that they could not provide long term stability without some significant phase separation of the solid and liquid components.

Some of the various patents related to liquid detergent compositions are listed below. Patent Applications 293 040 and 294 904, describe aqueous detergent compositions having a pH above 8 containing an anionic surfactant at conventional levels, i.e. above 5% by weight, typically from 15% to 40% by weight, and a solid, water-soluble peroxygen bleach dispersed in a specific water/solvent liquid phase.

EP-A-0 328 182 discloses liquid laundry detergent and fabric softener compositions containing a Smectite-type clay fabric softener and an antisettling agent in a low water/polyol formulation, and optionally, a polymeric clay-flocculating agent.

EP-A-0 110 472 discloses an aqueous liquid detergent composition comprising conventional detergent ingredients and from 1–10% by weight of silica with a surface area of greater than 200 $m^2/g$.

U.S. Pat. No. 4,075,118 discloses concentrated, low-sudsing liquid detergent compositions containing a mixture of nonionic surfactants, anionic surfactants and a self-emulsified silicone suds controlling agent.

EP-A-O 124 143 discloses a process for the preparation of a neutral or low-alkaline silica-containing aqueous liquid detergent composition, comprising detergent-active material and detergency builder, characterized by the step of admixing particulate alkalimetal silicate into the aqueous base at a temperature of below 50° C.

EP-A-9 839 discloses examples of some bleach compositions based on hydrogen peroxide which are well-known; such compositions are mainly used for hard-surface cleaning applications, and are not desirable for use during the washing cycle of a washing machine. Their drawbacks include low solution pH and therefore poor efficiency, and high level of free hydrogen peroxide in the product, not desirable for consumer safety reasons.

There is, therefore, a need for liquid detergent compositions containing bleach, suitable for use in washing machines, which do not have the dissolution, stability or phase separation problems of the prior art, and which, once added to the wash medium, can be immediately effective on the fabrics.

It has now been surprisingly found that stable liquid detergent compositions with bleach, having suspended solid peroxygen compound, can be formulated with hydrophobic silica, without impairing the chemical stability of the composition and while enhancing the physical stability of the composition. The present invention therefore answers the above-mentioned need, by providing liquid detergent compositions with bleach, containing solid peroxygen compound, which are stable upon storage, show excellent viscosity/pourability characteristics, and dissolve quickly and efficiently in the wash medium.

The present compositions, which exhibit an alkaline pH, allow one to obtain an optimal performance from the bleach component.

SUMMARY

The present invention relates to a stable liquid detergent composition having a pH of at least 8, comprising a solid, water-soluble peroxygen compound suspended in a liquid phase containing water and at least one water-miscible organic solvent, the amount of the solid water-soluble peroxygen compound being such that the amount of available oxygen provided by said peroxygen compound is from 0.5% to 3%, surfactant and silica, characterized in that the silica is a hydrophobic silica with an average primary particle size of .less than 40 nm and further characterized in that the amount of silica present is in a range of from 0.5% to 5% of the composition by weight.

DETAILED DESCRIPTION

The present invention relates to a stable liquid detergent composition having a pH of at least 8 and less than about 11, preferably a pH of at least 9, more preferably a pH of at least 9.5. The compositions comprise a solid, water-soluble peroxygen compound suspended in a liquid phase containing water and at least one water-miscible organic solvent, surfactant and hydrophobic silica. All percentages used herein, unless otherwise specified, are weight percentages based on the total composition.

The Water-Soluble Peroxygen Compound

The water-soluble solid peroxygen compound is present in the compositions herein preferably at levels of from 5 to 50% by weight of the total composition, more preferably from 5 to 40%, even more preferably from 5% to 30%, most preferably from 10% to 30% by weight.

Examples of suitable water-soluble solid peroxygen compounds include the perborates, persulfates, peroxydisulfates, perphosphates and the crystalline peroxyhydrates formed by reacting hydrogen peroxide with sodium carbonate (forming percarbonate) or urea. Preferred peroxygen bleach compounds are perborates and percarbonates.

Preferred in the present context is a perborate bleach in the form of particles having an average particle diameter of from 0.5 to 20 micrometers, more preferably 3 to 15 micrometers.

The small average particle size can best be achieved by in-situ crystallization, typically of perborate monohydrate.

In-situ crystallization encompasses processes involving dissolution and recrystallization, as in the dissolution of perborate monohydrate and subsequent formation of perborate tetrahydrate. Recrystallization may also take place by allowing perborate monohydrate to take up crystal water, whereby the monohydrate directly recrystallizes into the tetrahydrate, without dissolution step.

In-situ crystallization also encompasses processes involving chemical reactions, as when sodium perborate is formed by reacting stoichiometric amounts of hydrogen peroxide and sodium metaborate or borax.

The Water-Miscible Organic Solvent

The suspension system for the solid peroxygen component herein consists in a liquid phase that comprises water and a water-miscible organic solvent. This makes it possible to incorporate in the liquid detergent compositions herein a high amount of solid water-soluble peroxygen compound, while keeping the amount of available oxygen in solution below 0.5% by weight of the liquid phase, preferably below 0.1%. Less than one tenth of the total amount of peroxygen compound is dissolved in the liquid phase; the low level of available oxygen in solution is in fact critical for the stability of the system.

The standard iodometric method (as described for instance in Methoden der Organischen Chemie, Houben Weyl, 1953, Vo. 2, page 562) is suitable to determine the available oxygen (AVO) content of the composition.

In order to ensure complete equilibration between liquid and solid phases, the compositions are to be kept after mixing for three days at room temperature before the AVO titration. Before measuring the products are thoroughly shaken in order to ensure correct sampling.

For the determination of the available oxygen (AVO) in the liquid phase, samples of the compositions are centrifuged for 10 minutes at 10.000 rpm. The liquid is then separated from the solid and titrated for available oxygen.

It is not necessary that the organic solvent be fully miscible with water, provided that enough of the solvent mixes with the water of the composition to affect the solubility of the peroxygen compound in the described manner. Fully water-soluble solvents are preferred for use herein.

The water-miscible organic solvent must, of course, be compatible with the peroxygen bleach compound at the pH that is used. Therefore, polyalcohols having vicinal hydroxy groups (e.g. 1,2-propanediol and glycerol) are less desirable when the peroxygen bleach compound is perborate.

Example of suitable water-miscible organic solvents include the lower aliphatic monoalcohols; ethers of diethylene glycol and lower monoaliphatic monoalcohols; specifically ethanol, n-propanol; iso-propanol; butanol; polyethylene glycol (e.g., PEG 150, 200, 300, 400); dipropylene glycol; hexylene glycol; methoxyethanol; ethoxyethanol; butoxyethanol; ethyldiglycolether; benzylalcohol; butoxypropanol; butoxypropoxypropanol; and mixtures thereof. Preferred solvents include ethanol; isopropanol, 1-methoxy-2-propanol and butyldiglycolether. A preferred solvent system is ethanol. Ethanol may be preferably present in a water:ethanol ratio of 8:1 to 1:3.

Although the presence or absence of other ingredients plays a role, the Mount of available oxygen in solution is largely determined by the ratio water:organic solvent. It is not necessary however to use more organic solvent than is needed to keep the amount of available oxygen in solution below 0.5%, preferably below 0.1%.

In practical terms, the ratio water: organic solvent is, for most systems, in the range: from 5:1 to 1:3, preferably from 4:1 to 1:2.

The present liquid detergent compositions with bleach exhibit a pH (1% solution in distilled water) of at least 8 and less than about 11, preferably of at least 9, more preferably at least 9.5. The alkaline pH allows good bleaching action of the peroxygen compound, particularly when the peroxygen is a perborate.

The Hydrophobic Silica

Hydrophobic silica is also essential in the compositions of the present invention. Precipitated hydrophobic silica or fumed hydrophobic silica may be used; most preferred hydrophobic silica is fumed silica. The inclusion of silica helps thicken and structure the matrix of the liquid detergent compositions of the present invention, and thereby increases the stability of the bleach containing compositions of the present invention. It has also been found that combination of the silica with a polymer, up to a certain level, enhances the thickening and structuring properties of the silica, thus increasing the physical stability of the final dispersion. The optional combination with polymers, if used, is preferably formulated with a level from about 0.1% to 2% polymer by weight of the composition, most preferably from 0.1% to 1%. Any of a number of polymers with the ability to flocculate silica particles and form a flocculated sediment can be used in combinations of the present invention. Preferred polymers include polyethylene glycol and poly(oxiethylene) resins such as UNION CARBIDE POLYOX WSRN 3000®, and polycarboxylates.

The amount of hydrophobic silica present in the compositions of the present invention is preferably in a range of from 0.5% to 5% of the composition by weight, more preferably in a range of from 1 to 3%. It has also been found that the hydrophobic silica preferably has a specific surface are of less than 200 $m^2/g$, more preferably a specific surface area of between 50 to 150 $m^2/g$, even more preferably a specific surface area of between 80 to 130 $m^2/g$.

The average particle size of the hydrophobic silica found in the compositions of the present invention is critical in the present invention. The hydrophobic silica has an average primary particle size of less than 40 nm, more preferably in a range of 5 to 30 nm, most preferably in a range from 10 to 20 nm.

Surfactants

The compositions herein preferably contain a nonionic or cationic surfactant, or a mixture thereof, at total levels of from 1% to 20%, most preferably from 3% to 10%.

The nonionic surfactants are conventionally produced by condensing ethylene oxide with a hydrocarbon having a reactive hydrogen atom, e.g., a hydroxyl, carboxyl, or amido group, in the presence of an acidic or basic catalyst, and include compounds having the general formula $RA(CH_2CH_2O)_nH$ wherein R represents the hydrophobic moiety, A represents the group carrying the reactive hydrogen atom and n represents the average number of ethylene oxide moieties. R typically contains from about 8 to 22 carbon atom. They can also be formed by the condensation of propylene oxide with a lower molecular weight compound. n usually varies from about 2 to about 24.

The hydrophobic moiety of the nonionic compound is preferably a primary or secondary, straight or branched, aliphatic alcohol having from about 8 to about 24, preferably from about 12 to about 20 carbon atoms. A more complete disclosure of suitable nonionic surfactants can be found in U.S. Pat. No. 4,111,855. Mixtures of nonionic surfactants can be desirable.

A preferred class of nonionic ethoxylates is represented by the condensation product of a fatty alcohol having from 12 to 15 carbon atoms and from about 4 to 10 moles of ethylene oxide par mole of fatty alcohol.

Suitable species of this class of ethoxylates include: the condensation product of $C_{12}$–$C_{15}$ oxo-alcohols and 7 moles of ethylene oxide per mole of alcohol; the condensation product of narrow cut $C_{14}$–$C_{15}$ oxo-alcohols and 7 or 9 moles of ethylene oxide per mole of fatty(oxo)alcohol; the condensation product of a narrow cut $C_{12}$–$C_{13}$ fatty(oxo) alcohol and 6,5 moles of ethylene oxide par mole of fatty alcohol; and the condensation products of a $C_{10}$–$C_{14}$ coconut fatty alcohol with a degree of ethoxylation (moles EO/mole fatty alcohol) in the range from 5 to 8. The fatty oxo-alcohols while mainly linear can have, depending upon the processing conditions and raw material olefins, a certain degree of branching, particularly short chain such as methyl branching.

A degree of branching in the range from 15% to 50% (weight %) is frequently found in commercial oxo alcohols.

Preferred nonionic ethoxylated components can also be represented by a mixture of 2 separately ethoxylated nonionic surfactants having a different degree of ethoxylation. For example, the nonionic ethoxylate surfactant containing from 3 to 7 moles of ethylene oxide per mole of hydrophobic moiety and a second ethoxylated species having from 8 to 14 moles of ethylene oxide per mole of hydrophobic moiety. A preferred nonionic ethoxylated mixture contains a lower ethoxylate which is the condensation product of a $C_{12}$–$C_{15}$ oxo-alcohol, with up to 50% (wt) branching, and from about 3 to 7 moles of ethylene oxide per mole of fatty oxo-alcohol, and a higher ethoxylate which is the condensation product of a $C_{16}$–$C_{19}$ oxo-alcohol with more than 50% (wt) branching and from about 8 to 14 moles of ethylene oxide per mole of branched oxo-alcohol.

Semi-polar nonionic surfactants include water-soluble amine oxides containing one alkyl or hydroxy alkyl moiety of from about 8 to about 28 carbon atoms and two moieties selected from the group consisting of alkyl groups and hydroxy alkyl groups, containing from 1 to about 3 carbon atoms which can optionally be joined into ring structures.

The liquid detergent compositions of the present invention optionally contain a cationic surfactant, preferably from 0.1% to 10%, more preferably 0.1% to 5%, by weight of the composition.

Examples of suitable cationic surfactants include quaternary ammonium compounds of the formula $R_1R_2R_3R_4N^+X^-$, wherein $R_1$ is $C_{12}$–$C_{20}$ alkyl or hydroxyalkyl; $R_2$ is $C_1$–$C_4$ alkyl or hydroxyalkyl, or $C_{12}$–$C_{20}$ alkyl or hydroxyalkyl; $R_3$ and $R_4$ are each $C_1$–$C_4$ alkyl or hydroxyalkyl, or $C_6$–$C_8$ aryl or alkylaryl; and $X^-$ is halogen. Preferred are mono-long chain quaternary ammonium compounds (i.e., compounds of the above formula wheren $R_2$ is $C_1$–$C_4$ alkyl or hydroxyalkyl).

Zwitterionic surfactants which could be used in the compositions of the present invention include derivatives of aliphatic quaternary ammonium, phosphonium, and sulphonium compounds in which the aliphatic moiety can be straight or branched chain and wherein one of the aliphatic substituents contains from about 8 to about 24 carbon atoms and another substituent contains, at least, an anionic water-solubilizing group. Particularly preferred zwitterionic materials are the ethoxylated ammonium sulfonates and sulfates disclosed in U.S. Pat. Nos. 3,925,262, Laughlin et al., issued Dec. 9, 1975 and 3,929,678, Laughlin et al., issued Dec. 30, 1975.

The compositions herein may also contain anionic surfactants. The anionic detergents are well-known in the detergent arts and have found wide-spread application in commercial detergents. Suitable anionic synthetic surface-active salts are selected from the group of sulfonates and sulfates. Preferred anionic synthetic water-soluble sulfonate or sulfate salts have in their molecular structure an alkyl radical containing from about 8 to about 22 carbon atoms.

Accordingly, anionic surfactants, if used, are present at levels up to 40% by weight, preferably from 1% to 30% by weight, even more preferably from 5% to 20% by weight.

Synthetic anionic surfactants, can be represented by the general formula $R^1SO^3M$ wherein $R^1$ represents a hydrocarbon group selected from the group consisting of straight or branched alkyl radicals containing from about 8 to about 24 carbon atoms and alkyl phenyl radicals containing from about 9 to about 15 carbon atoms in the alkyl group. M is a salt forming cation which typically is selected from the group consisting of sodium, potassium, ammonium, and mixtures thereof. A preferred synthetic anionic surfactant is a water-soluble salt of an alkylbenzene sulfonic acid containing from 9 to 15 carbon atoms in the alkyl group. Another preferred synthetic anionic surfactant is a water-soluble salt of an alkyl sulfate or an alkyl polyethoxylate ether sulfate wherein the alkyl group contains from about 8 to about 24, preferably from about 10 to about 20 carbon atoms, and preferably from about 1 to about 12 ethoxy groups. Other suitable anionic surfactants are disclosed in U.S. Pat. No. 4,170,565, Flesher et al., issued Oct. 9, 1979.

Examples of such preferred anionic surfactant salts are the reaction products obtained by sulfating $C_8$–$C_{18}$ fatty alcohols derived from tallow and coconut oil; alkylbenzene sulfonates wherein the alkyl group contains from about 9 to 15 carbon atoms; sodium alkylglyceryl ether sulfonates; ether sulfates of fatty alcohols derived from tallow and coconut oils; coconut fatty acid monoglyceride sulfates and sulfonates; and water-soluble salts of paraffin sulfonates having from about 8 to about 22 carbon atoms in the alkyl chain. Sulfonated olefin surfactants as more fully described in e.g. U.S. Pat. No. 3,332,880 can also be used. The neutralizing cation for the anionic synthetic sulfonates and/or sulfates is represented by conventional cations which are widely used in detergent technology such as sodium and potassium.

A particularly preferred anionic synthetic surfactant component herein is represented by the water-soluble salts of an alkylbenzene sulfonic acid, preferably sodium alkylbenzene sulfonates having from about 10 to 13 carbon atoms in the alkyl group.

Builders

The present compositions may contain a builder, preferably at a level no more than 50%, more preferably at a level of from 5% to 40% of the total composition.

If present, such builders can consist-of the inorganic or organic types already described in the art.

The liquid detergent compositions herein optionally may contain, as a builder, a fatty acid component. Preferably, however, the amount of fatty acid is less than 10% by weight of the composition, more preferably less than 4%. Preferred saturated fatty acids have from 10 to 16, more preferably 12 to 14 carbon atoms. Preferred unsaturated fatty acids are oleic acid and palmitoleic acid.

Examples of inorganic builders include the phosphourus-based builders, e.g., sodium tripolyphosphate, sodium pyrophosphate, and aluminosilicates (zeolites).

Examples of organic builders are represented by polyacids such as citric acid, nitrilotriacetic acid, and mixtures of tartrate monosuccinate with tartrate disuccinate. Preferred builders for use herein are citric acid and alk(en)yl-substituted succinic acid compounds, wherein alk(en)yl contains from 10 to 16 carbon atoms. An example of this group of compounds is dodecenyl succinic acid. Polymeric carboxylate builders such as polyacrylates, polyhydroxy acrylates and polyacrylates/-polymaleates copolymers can also be used.

Other Components/Additives

The compositions herein may also contain other components and/or additives at a level preferably less than about 5%. Non-limiting examples of such additives, which can more preferably be used at levels from 0.05% to 2%, include polyaminocarboxylate additives such as ethylenediaminotetracetic acid, diethylenetriaminopentacetic acid, ethylenediamino disuccinic acid or the water-soluble alkali metals thereof. Other additives useful at these levels include organo-phosphonic acids; particularly preferred are ethylenediamino tetramethylenephosphonic acid, diethylenetriamino pentamethylenephosphonic acid and aminotrimethylenephosphonic acid, hydroxyethylidene diphosphonic acid. Bleach stabilizers such as ascorbic acid, dipicolinic acid, sodium starmates, 8-hydroxyquinoline, hydroxyethylidene diphosphonic acid (HEDP), and diethylenetriamine penta(methylene phosphonic acid) can also be included in these compositions at these levels, more preferably at .levels from between 0.01 to 1%.

The compositions herein can contain a series of further optional ingredients which are mostly used in additive levels, usually below about 5%. Examples of the like include: polyacids, enzymes and enzymatic stabilizing agents, suds regulants, opacifiers, agents to improve the machine compatibility in relation to enamel-coated surfaces, bactericides, dyes, perfumes, brighteners, softeners and the like.

As described above, detergent enzymes can be used in the liquid detergent compositions of this invention. In fact, one of the desirable features of the present compositions is that they are compatible with such detergent enzymes. Suitable enzymes include the detergent proteases, amylases, lipases and cellulases. Enzymatic stabilizing agents for use in liquid detergents are well known. Enzyme stabilizing agents, if used, are preferably in a range of from about 0.5% to 5%. Preferred enzymatic stabilizing agents for use herein are formic acid, acetic acid, and salts thereof, e.g. sodium formate and sodium acetate. More preferred stabilizing agents are sodium formate and acetic acid.

Use of the Compositions

The present compositions are mainly intended to be used in the wash cycle of a washing machine; however, other uses can be contemplated, such as pretreatment product for heavily-soiled fabrics, or soaking product; the use is not necessarily limited to the washing-machine context, and the compositions of the present invention can be used alone or in combination with compatible handwash compositions.

Some typical liquid detergent compositions of the present invention have the following formulae:

| Ingredients | Composition wt % | | | |
|---|---|---|---|---|
| | I | II | III | IV |
| Linear alkyl benzene sulfonate | 10 | 10 | 10 | 10 |
| $C_{13}$–$C_{15}$ alcohol ethoxylated ($EO_3$) | 5 | 5 | 5 | 5 |
| Citric Acid | 2.5 | 2.5 | 2.5 | 2.5 |
| Dodecenyl succinic acid | 8.5 | 8.5 | 8.5 | 8.5 |
| Polymeric carboxylate builder | 1.5 | 1.5 | 1.5 | 1.5 |
| Tallow fatty acid | — | — | — | 2 |
| Diethylenetriamino penta (methylene phosphonic acid) | 0.5 | 0.5 | 0.5 | 0.5 |
| Hydroxyethylidene diphosphonic acid | 0.2 | 0.2 | 0.2 | 0.2 |
| Sodium formate | 1.5 | 1.5 | 1.5 | 1.5 |
| Acetic acid | 1.4 | 1.4 | 1.4 | 1.4 |
| Ethanol | 10 | 10 | 12 | 10 |
| Sodium perborate monohydrate | 14 | — | 14 | — |
| Sodium perborate tetrahydrate | — | 20 | — | 22 |
| Hydrophobic silica | 1.5 | 1.0 | 1.5 | 0.5 |
| Sodium hydroxide | up to pH 9.5 | | | |
| Water + minors (perfume, brightener, enzymes, . . . ) | balance to 100 | | | |

The liquid detergent compositions are, in general, prepared according to a method of in-situ recrystallization of sodium perborate. An example of such a method is found below.

Part of the solvent(s) and the phosphonic acid are dissolved in water and the pH is adjusted to about 8 with sodium hydroxide. The surfactant (s) is (are) then added and, if needed, the pH is adjusted back to 8 with sodium hydroxide.

The sodium perborate monohydrate is then added under stirring, at room temperature; it recrystallizes to perborate tetrahydrate within a few hours of stirring. The recrystallization process can be speeded up by adding, prior to the perborate, some seed crystals of sodium perborate tetrahydrate of small particle size (5–10 microns). In practice this is best done by adding a small percentage (less than 10%, typically around 5%) of the finished composition of this invention. Bleach-containing dilute aqueous detergent compositions (such as described in EP-A-293 040 and EP-A-294 904) can also be used as seeding compositions.

Silica dissolves in water at high pH to form $HSiO_3^-$ above pH 10.3 and $SiO_4^{2-}$ above pH 13. Therefore, the pH of the preparation needs to be carefully controlled after the addition of silica in order to avoid any pH jump above 10, otherwise the physical stabilizing effect of silica will be reduced or lost. Quantitative and easy addition of the silica is obtained by premixing silica with a part of the organic solvent, especially with the lower aliphatic monoalcohols, and especially with ethanol. The liquid-like dispersion of silicon is added to the preparation after in-situ recrystallization of the sodium perborate compound or after in-situ crystallization of a liquid form of this material.

After the recrystallization and silica addition are completed, minor ingredients such as dyes, perfumes, etc. are added.

The composition can also be prepared by reacting in situ hydrogen peroxide and sodium metaborate (or borax). In this case sodium metabolite powder is added to the solvent(s)/surfactant(s) solution: then an aqueous solution of hydrogen peroxide is added. Sodium perborate tetrahydrate crystallizes from the solution, and then the product is completed as described above.

The compositions of the above Examples show perfectly acceptable viscosity characteristics, and have excellent stability behaviour upon storage.

We claim:

1. A stable liquid detergent composition having a pH of at least 8 and less than about 11, comprising: a solid, water-soluble peroxygen compound having a particle size of from about 0.5 to about 20 micrometers, suspended in a liquid phase containing water and at least one water-miscible organic solvent, provided that the water:solvent ratio is from about 8:1 to about 1:3; and that less than one tenth of the total amount of peroxygen compound is dissolved in the liquid phase, and that the amount of the solid water-soluble peroxygen compound being such that the amount of available oxygen provided by said peroxygen compound is from 0.5% to 3%; surfactant; from about 5% to about 40% builder: and silica, characterized in that the silica is a hydrophobic silica with an average primary particle size of less than 40 nm and a specific surface area of less than 200 $m^2/g$, and further characterized in that the amount of silica present is in a range of from 0.5% to 5% of the composition by weight.

2. A detergent composition, according to claim 1, wherein the hydrophobic silica has a specific surface area in the range of 50 to 150 $m^2/g$.

3. A detergent composition, according to claim 2, wherein the hydrophobic silica has a specific surface area of between 80 to 130 $m^2/g$.

4. A detergent composition according to claim 1 wherein the amount of silica present is in a range of from 1% to 3%.

5. A detergent composition, according to claim 1, 2, 3 or 4 wherein the average primary particle size of the hydrophobic silica is in a range of 5 to 30 nm.

6. A detergent composition, according to claim 3 or 4, wherein the average primary :particle size of the hydrophobic silica is in a range of 10 to 20 nm.

7. A detergent composition according to claim 3 or 4, wherein the water-miscible organic solvent is an aliphatic monoalcohol.

8. A detergent composition according to claim 7, wherein the water-miscible organic solvent is ethanol.

9. A detergent composition according to claim 6 wherein the water-soluble peroxygen compound is present at levels of from 5–30% by weight.

10. A detergent composition according to claim 1 further comprising from about 0.1% to about 2% by weight of composition of a polymer wherein said polymer is capable of forming a flocculated sediment with said hydrophobic silica particles.

11. A detergent composition according to claim 10 wherein said polymer is selected from the group consisting of polyethylene glycol, poly(oxyethylene) resins, and mixtures thereof.

* * * * *